US009174712B2

(12) United States Patent
Klotz

(10) Patent No.: US 9,174,712 B2
(45) Date of Patent: Nov. 3, 2015

(54) LINE DEPLOYING APPARATUS

(71) Applicant: Manfred Klotz, Bond Head (CA)

(72) Inventor: Manfred Klotz, Bond Head (CA)

(73) Assignee: Manfred Klotz, Bond Head, Ontario (CA)

( * ) Notice: Subject to any disclaimer, the term of this patent is extended or adjusted under 35 U.S.C. 154(b) by 191 days.

(21) Appl. No.: 13/769,996

(22) Filed: Feb. 19, 2013

(65) Prior Publication Data

US 2013/0244515 A1 Sep. 19, 2013

Related U.S. Application Data

(60) Provisional application No. 61/610,692, filed on Mar. 14, 2012.

(51) Int. Cl.
*B63C 9/08* (2006.01)
*B63C 9/20* (2006.01)

(52) U.S. Cl.
CPC .. *B63C 9/082* (2013.01); *B63C 9/20* (2013.01)

(58) Field of Classification Search
USPC ..... 242/405, 407, 608, 613.1; 441/81, 84
See application file for complete search history.

(56) References Cited

U.S. PATENT DOCUMENTS

| | | | | |
|---|---|---|---|---|
| 2,342,868 | A * | 2/1944 | King | 441/81 |
| 3,626,495 | A * | 12/1971 | Bastian, Jr. | 242/405.2 |
| 3,714,838 | A | 2/1973 | Gilson | |
| 3,934,838 | A * | 1/1976 | D'Amico | 242/405.1 |
| 4,449,947 | A * | 5/1984 | Brault | 441/81 |
| 4,678,135 | A | 7/1987 | Jones | |
| 5,562,512 | A | 10/1996 | Samelian | |
| 5,895,299 | A | 4/1999 | Hyde | |
| 6,629,867 | B1 * | 10/2003 | Smith | 441/81 |
| D493,922 | S | 8/2004 | Klotz | |
| 2010/0216359 | A1 | 8/2010 | Samelian | |

FOREIGN PATENT DOCUMENTS

| | | | |
|---|---|---|---|
| CA | 2419140 | A1 | 4/2002 |
| CA | 2735304 | A1 | 9/2012 |
| DE | 30 10 529 | A1 | 10/1980 |
| WO | WO02-26557 | A1 | 4/2002 |

OTHER PUBLICATIONS

Canadian Office Action for CA 2,783,104 dated Jul. 9, 2014.
Canadian Office Action for CA 2,783,104 dated Oct. 3, 2013.

* cited by examiner

*Primary Examiner* — Sang Kim
(74) *Attorney, Agent, or Firm* — Morris & Kamlay LLP

(57) ABSTRACT

An apparatus for deploying a line includes a disc having a generally V-shaped circumferential channel for retaining the line prior to deployment. The V-shaped channel guides a first wound turn of the line toward the central plane of the disc, and provides an enlarged space into which the turns of the line are unwound during deployment. The enlarged space prevents tangling of the line when the turns are unwound from the disc during deployment.

19 Claims, 8 Drawing Sheets

LINE DEPLOYING APPARATUS

FIELD OF THE INVENTION

The instant invention relates generally to an apparatus for deploying a line, such as for instance a rope or a cord, and more particularly to a throwable line-deploying apparatus for use in water rescues and in other situations.

BACKGROUND OF THE INVENTION

There are numerous situations in which it is desirable to be able to deploy a line, such as a rope or a cord, over a distance and in a controllable fashion. For instance, during a water-rescue attempt a rescuer must be able to deploy a line with a high degree of accuracy and reliability, so that a person in the water can grasp onto the line and be pulled back to safety. It is also advantageous to provide a flotation device to the person in the water, in order to at least partially support that person in the water and thereby facilitate the rescue. Desirable features of a water rescue device include: buoyancy; accuracy and reach during deployment; compact size and easy to use; does not dive during rescue retrieval; constructed of materials that are not likely to cause injury to the person in the water and may be easily gripped; etc.

Although a wide variety of water rescue devices are known in the art, none are considered to be entirely satisfactory. For instance, U.S. Pat. Nos. 5,562,512 and 5,895,299 describe flying rescue discs with retrieval line retention and deployment features that are disposed on or about the outside periphery of the disc. WO 02/26557 describes another flying rescue disc, in which the retrieval line is wound within an internal compartment opening to the underside of the disc. DE 30 10 529 describes a flying rescue disc in which the retrieval line is wound within a rectangular-shaped channel extending around the periphery of the disc. In each case, the disc is thrown with a rotational motion such that the line that is wound around the disc is caused to deploy while the disc is in flight. After the disc lands in the water, the person that is being rescued grasps onto the line and/or the disc and is pulled to safety.

Unfortunately, each of the above-mentioned devices employs a line deploying system that may lead to the line becoming tangled as it deploys, thereby reducing both reliability and accuracy. A common feature of these devices is a circumferential channel, which is defined by grooves or flanges extending around the periphery of the disc, for retaining the retrieval line before it is deployed. The width of the circumferential channel, in each case, is constant or increases along a radial inward direction from the edge of the disc toward the center of the disc. Further, the width of the channel is sufficient to allow successive turns of the retrieval line to be wound side-by-side, even at the base of the channel. Unless considerable care is exercised when the retrieval line is being wound around the disc, it is possible that the turns of the retrieval line will overlap one another in such a way that some of the turns prevent other turns from unwinding when the line is subsequently deployed. When this happens, the disc is likely to either fall short of its intended target or fly off course, in either case reducing deployment accuracy and therefore jeopardizing the safety of the person in the water.

A further drawback associated with the above-mentioned devices is that the circumferential channel, which retains the retrieval line, does not guide the deployment of the retrieval line along substantially the mid-plane of disc. That is to say, the circumferential channel of the prior art devices are displaced away from the mid-plane of the disc and/or the width of the circumferential channel is constant. As a result, the prior art devices are prone to wobbling during flight, and additionally they must be thrown with the correct end surface facing up. Further, the devices may be prone to diving during retrieval, due to the asymmetric placement of the channel and therefore the asymmetric attachment of the line to the device.

Of course, there are other situations in which it is also desirable to be able to deploy a line with similar accuracy and reliability. For instance, it is often necessary to toss a line from a boat to a person that is standing on a dock, or to toss a tie-down line over the top of a load that is being secured in the bed of a trailer or a truck. It is common, in such non-emergency situations, to improvise by simply "balling up" the line and heaving it generally in the direction of an intended recipient. If the first attempt is unsuccessful, then the line is retrieved and another attempt is made. Of course, such a trial and error approach is time-consuming and leads to frustration if success is not achieved after a few attempts.

It would therefore be beneficial to provide an apparatus for deploying a line for water rescues and for other situations, which overcomes at least some above-mentioned limitations of the prior art devices.

SUMMARY OF EMBODIMENTS OF THE INVENTION

According to an aspect of an embodiment of the instant invention, there is provided an apparatus for deploying a line, comprising: a disc having a top side, a bottom side, and an edge extending circumferentially around the disc, a generally V-shaped circumferential channel being defined between the top side and the bottom side and being open at the edge of the disc, the circumferential channel having opposing sidewalls that converge one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane, wherein the circumferential channel accommodates a predetermined length of the line when the line is wound onto the disc, and wherein the opposing sidewalls of the circumferential channel cooperate to guide a first turn of the line that is wound onto the disc toward the central plane.

According to an aspect of an embodiment of the instant invention, there is provided an apparatus for deploying a line, comprising: a throwable disc having a top side, a bottom side, and an edge extending circumferentially around the disc, a generally V-shaped circumferential channel being defined between the top side and the bottom side of the disc and being open at the edge of the disc, the circumferential channel having opposing sidewalls that converge one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane; and a line having one end attached to the disc and having a free end opposite the attached end, the free end for being grasped by a user throwing the throwable disc, wherein the circumferential channel houses a predetermined length of the line when the line is in a wound condition, and wherein the opposing sidewalls of the circumferential channel cooperate to guide a first turn of the line that is wound onto the disc toward the central plane.

According to an aspect of an embodiment of the instant invention, there is provided an apparatus for deploying a line, comprising: a throwable disc fabricated from a material that is buoyant in water, the disc having a top side, a bottom side, and an edge extending circumferentially around the disc, a generally V-shaped circumferential channel being defined between the top side and the bottom side of the disc and being open at the edge of the disc, the circumferential channel having opposing sidewalls that converge one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane; and a line that is buoyant in water and having one end attached to the disc and having a free end opposite the attached end, the free end for being grasped by a user throwing the throwable disc, wherein the V-shaped circumferential channel houses a predetermined length of the line when the line is in a wound condition, and wherein the opposing sidewalls of the circumferential channel cooperate to guide a first turn of the line that is wound onto the disc toward the central plane.

BRIEF DESCRIPTION OF THE DRAWINGS

The instant invention will now be described by way of example only, and with reference to the attached drawings, wherein similar reference numerals denote similar elements throughout the several views, and in which.

DETAILED DESCRIPTION OF EMBODIMENTS OF THE INVENTION

The following description is presented to enable a person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the scope of the invention. Thus, the present invention is not intended to be limited to the embodiments disclosed, but is to be accorded the widest scope consistent with the principles and features disclosed herein.

Figure 1A:
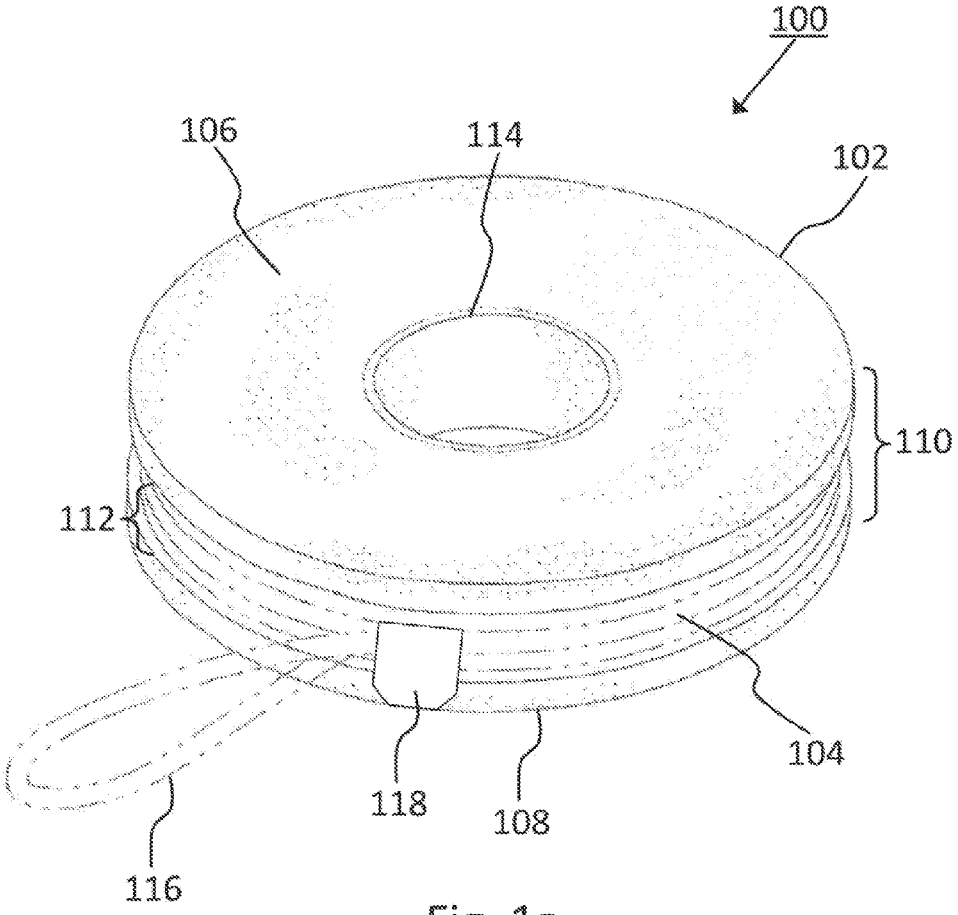
FIG. 1*a* is a front elevation view showing a line deploying apparatus according to an embodiment of the instant invention, with a line wound thereon.
Figure 1B:
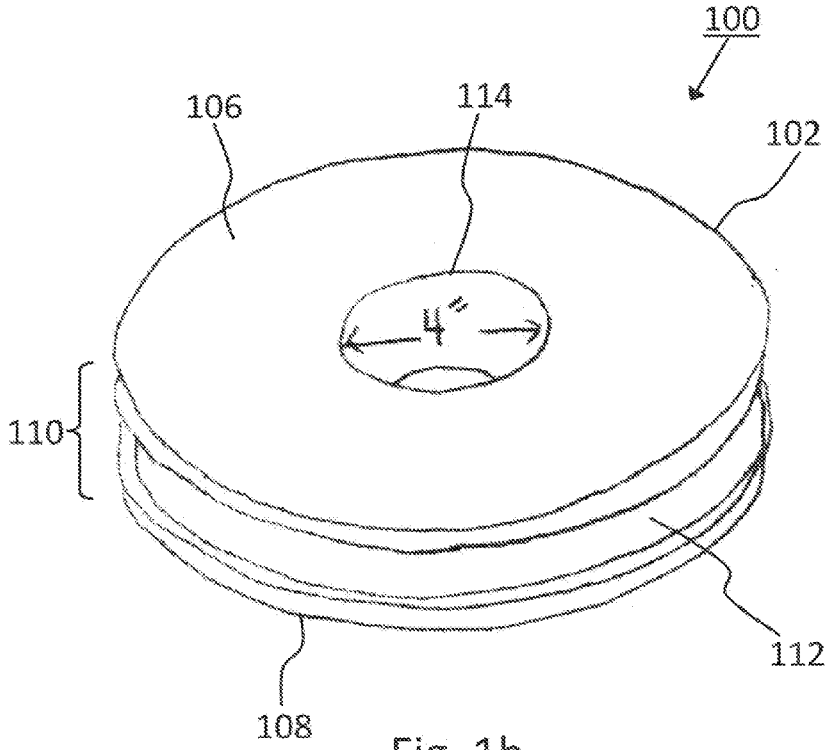
FIG. 1*b* is a front elevation view showing the disc portion of the line deploying apparatus of FIG. 1*a*, without the line wound thereon.

FIG. 1*a* is a front elevation view of a line deploying apparatus 100 according to an embodiment of the instant invention, shown in a storage condition. By way of a specific and non-limiting example, the line deploying apparatus 100 of FIG. 1*a* is intended for use in water-rescue situations and the like. The line deploying apparatus 100 comprises a disc 102 and a line 104. The disc 102, which is also shown in FIG. 1*b* without the line 104 being wound thereon, has a top side 106, a bottom side 108 and an edge 110 having a circumferential channel 112. A hole 114 extends through the disc 102 between central openings that are defined one each in the top side 106 and in the bottom side 108 of the disc 102. In a water rescue situation, the hole 114 provides a convenient feature for a victim to grasp onto.

As is further shown in FIG. 1*a*, the circumferential channel 112 is sized such that the line 104 is substantially contained within the channel 112 when the line 104 is wound onto the disc 102. The line 104 has a free end that is formed into a loop 116 for being grasped by a user, and a secured end opposite the free end attached to the disc 102. Optionally, a second loop (not shown) is provided proximate the secured end of the line 104 for being grasped by a person in the water during a rescue attempt. Optionally, a retaining clip 118 is provided in order to prevent unintentional unwinding of the line 104 prior to use.

For water-rescue applications, the disc 102 is fabricated preferably from a buoyant material. For instance, the disc 102 is fabricated from plural layers of a rigid foam material, the individual layers of foam being laminated together using a known process. Using a light-weight foam material to form the disc 102 not only provides buoyancy, but it also reduces the risk that a person in the water will be injured if they are struck by the thrown disc 102. Preferably, the top side 106 and the bottom side 108 of the disc 102 are formed with a surface texture that is easily gripped even when the disc 102 is wet. A suitable diameter of the disc 102, at least for water-rescue applications, is approximately 10.5 inches, a suitable thickness of the disc 102 is approximately 2.5 inches, and a suitable diameter of the hole 114 is approximately 4 inches. The line 104 is preferably a buoyant line having a length that is between at least 50 and 52 feet, and is at least 6 mm in diameter. Of course, optionally the line 104 has different characteristics, depending for instance on local boating safety regulations and/or the intended use of the apparatus 100, etc. For different applications, the disc 102 may be either larger or smaller than the above-noted dimensions, and the line 104 need not be buoyant. Further, for different applications the line 104 may be of any suitable length as required by such applications. For instance, for tying down loads the line may be provided in a 25-foot length, or a 40-foot length, or a 100-foot length, etc. Optionally, for applications in which the length of the line is not dictated by government boating safety regulations, a plurality of different products may be offered for sale with each different product having a different length of line wound thereon. Consumers may then select a particular one of the plurality of different products, depending upon his or her specific needs.

Figure 1C:
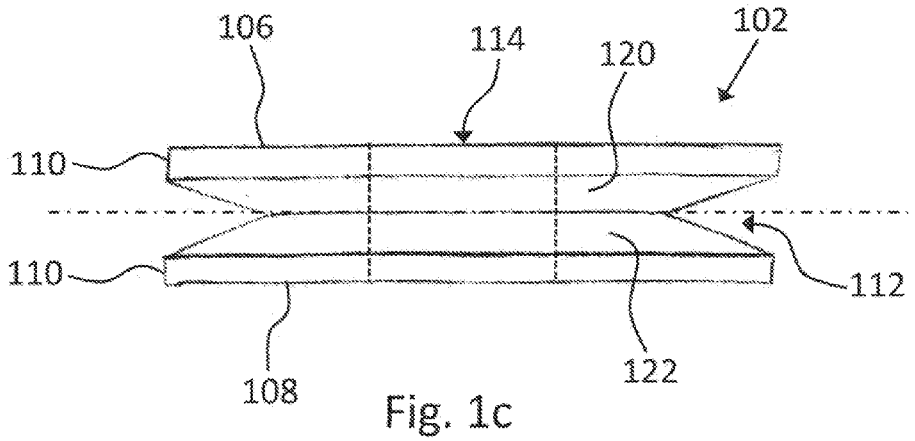
FIG. 1*c* is a side view of the disc portion of the line deploying apparatus of FIG. 1*a*, without the line wound thereon and showing detail of the generally V-shaped circumferential channel.
Figure 1D:
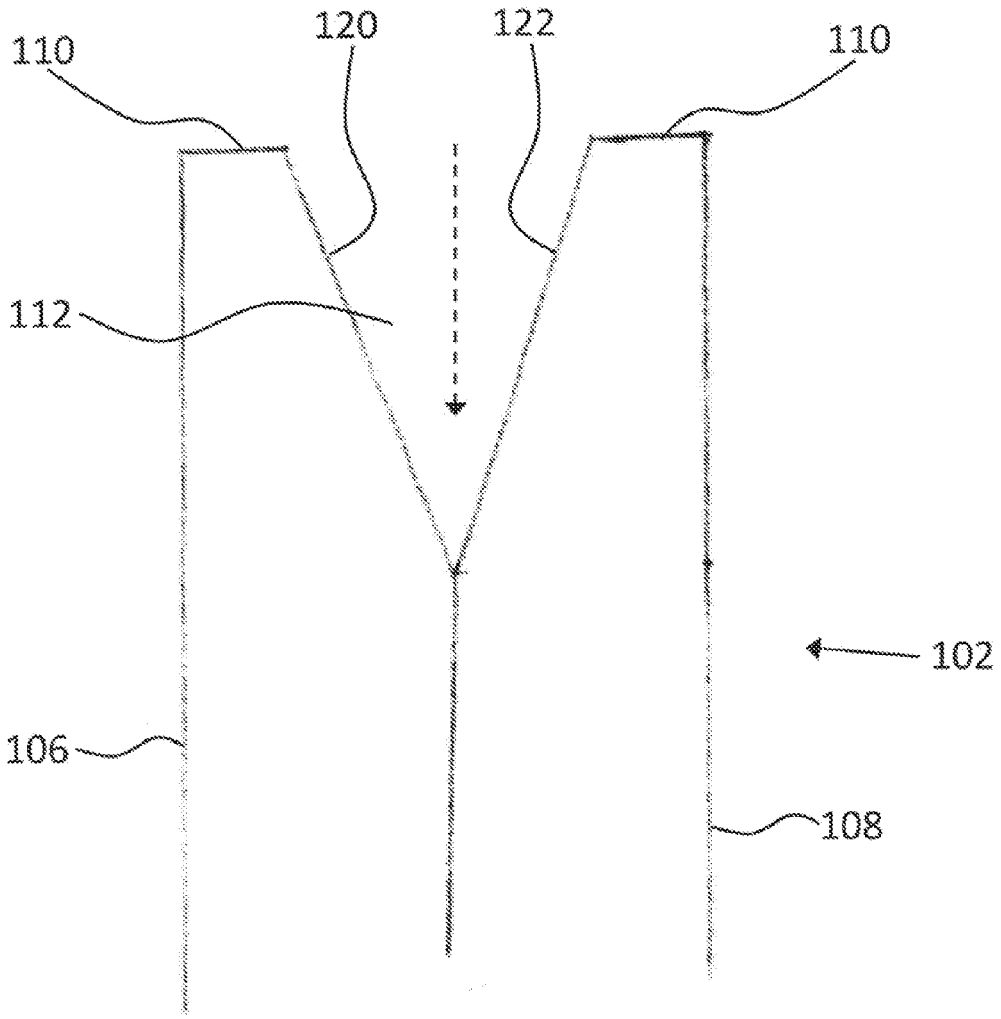
FIG. 1*d* is an enlarged side view showing structural detail proximate the edge of the disc portion of the line deploying apparatus of FIG. 1*a*, without the line wound thereon.

FIG. 1*c* is a side view of the disc 102, showing the circumferential channel 112 in greater detail. In particular, the circumferential channel 112 is generally V-shaped and it extends continuously around the edge 110 of the disc 102. Further, the circumferential channel 112 runs substantially parallel to both the top side 106 and the bottom side 108 of the disc 102. Now referring also to FIG. 1*d*, shown is an enlarged view of the circumferential channel 112 proximate the edge 110 of the disc 102. The circumferential channel 112 is defined by opposing sidewalls 120 and 122, which converge one toward the other along the radial inward direction that is indicated by the dash-line arrow in FIG. 1*d*, such that the width of the circumferential channel 112 decreases continuously in a direction toward the center of the disc 102. Further, the circumferential channel 112 is substantially symmetric about a central plane of the disc 102, as denoted by the dash-dot line in the side view of FIG. 1*c*, which is defined midway between the top side 106 and the bottom side 108 of the disc 102. The opposing sidewalls 120 and 122 intersect one another at this central plane. For the disc 102 shown in FIGS. 1*a-c*, suitable dimensions for the circumferential channel 112 include a depth of about 2 inches and a maximum width (at the edge 110) of about 1.25 inches.

In the line deploying apparatus 100, the converging sidewalls 120 and 122 define a circumferential channel 112 that has a markedly different shape compared to any of the prior art devices. As was noted above, the channels of the prior art devices have a constant width or a width that increases in a direction toward the center of the device.

Figure 2:
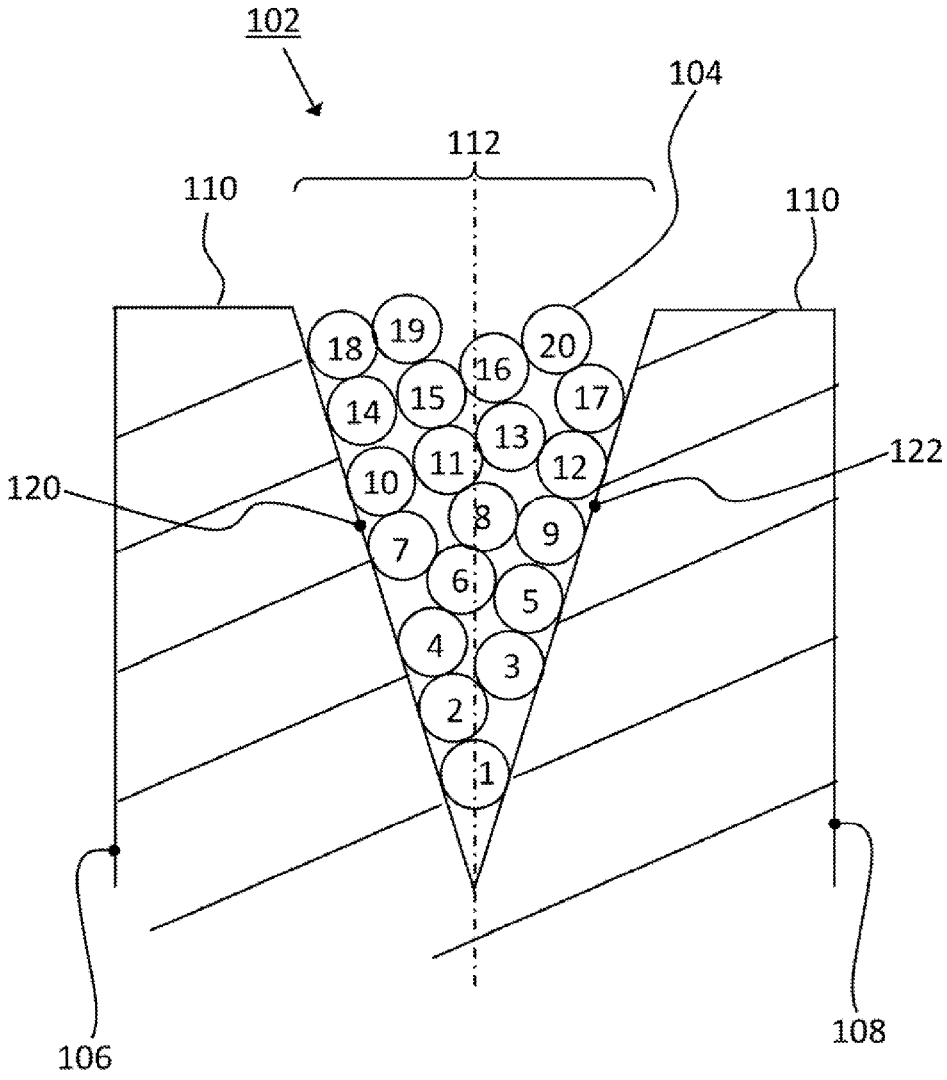
FIG. 2 is simplified cross-sectional view showing enlarged detail proximate the edge of the disc portion of the line deploying apparatus of FIG. 1*a*, with plural turns of line wound thereon.

Referring now to FIG. 2, the sidewalls 120 and 122 of the V-shaped circumferential channel 112 cooperate to guide the initial turns (e.g., 1, 2, 3, 4, etc.) of the line 104 toward the central plane of the disc 102. Unlike the prior art devices, the width of the channel 112 decreases to zero such that initially there is insufficient space for the turns of the line 104 to be wound in a side-by-side manner. Since the line 104 is guided toward the central plane of the disc 102 during winding of the initial turns, there is a reduced likelihood that the line 104 will be wound in such a manner that the earlier-wound turns (e.g., at least turns 7 through 9) interfere with the unwinding of the later-wound turns (e.g., turns 10 through 13). Another feature that is unique to the line-deploying apparatus 100 is that when the line 104 is being deployed, the turns (i.e., turns 1 through 20) are pulled off the apparatus along a direction in which the width of the channel 112 increases. The increasing width of the channel, along the direction of line deployment, reduces frictional forces occurring between the sidewalls 120 or 122 and the turns of the line 104, and provides an enlarged space to accommodate unwinding of the turns. In this way, turns that are disposed between a sidewall and an adjacent turn (e.g., turn 14 in FIG. 2) are reliably deployed without causing a tangle in the line 104.

Further, as the line 104 unwinds during deployment, and therefore the weight of the apparatus 100 decreases, the remaining turns of the line 104 (e.g. turns 1 through 6) are unwound from an increasingly central portion of the disc 102, thereby increasing the stability of the disc in flight. The V-shape of the circumferential channel 112 contributes to flight stability of the disc 102, resulting in improved accuracy compared to the prior art devices, and reduces the risk that the line 104 will become tangled as it unwinds from the disc 102, resulting in improved reliability and accuracy compared to the prior art devices.

Figure 3A:
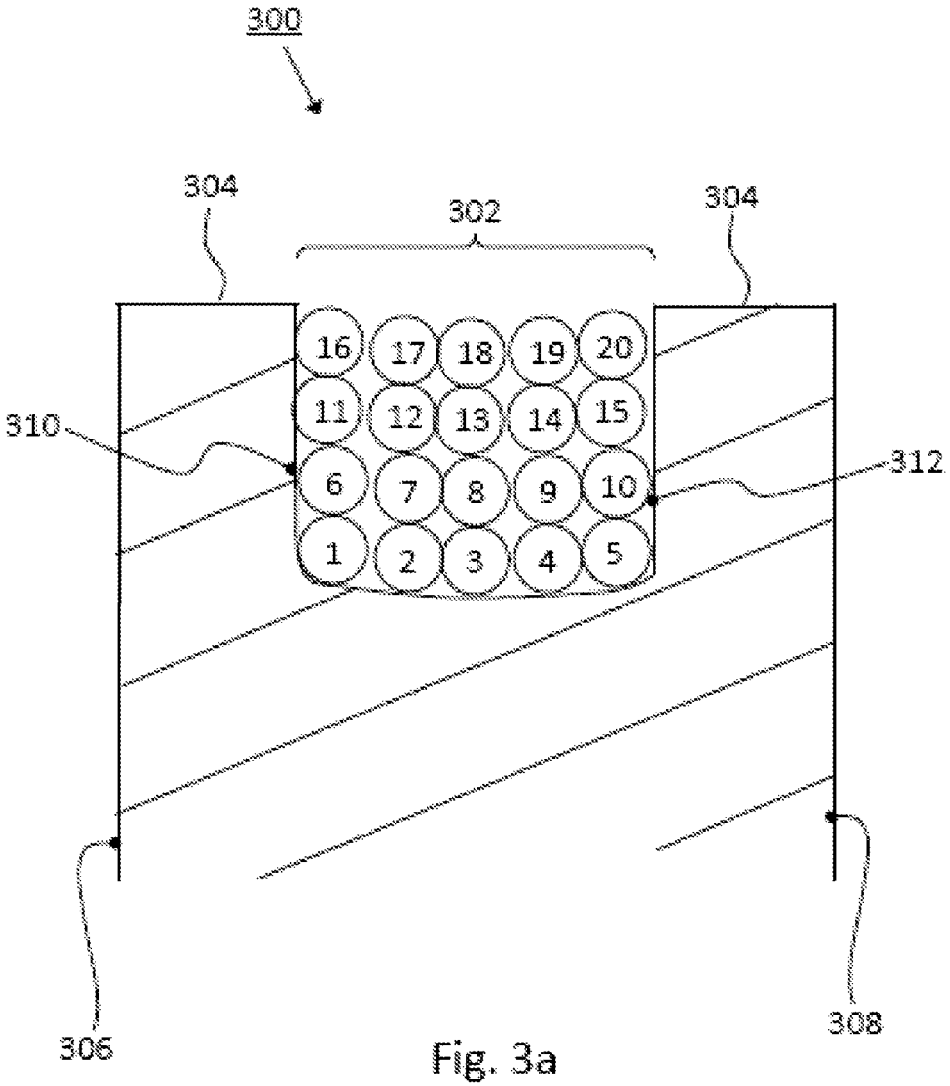
Fig. 3a (Prior Art)
FIG. 3*a* is a simplified cross-sectional view showing enlarged detail of the edge of a prior art line deploying apparatus, and depicts a plurality of turns of a line that is properly wound within the generally rectangular-shaped channel.
Figure 3B:
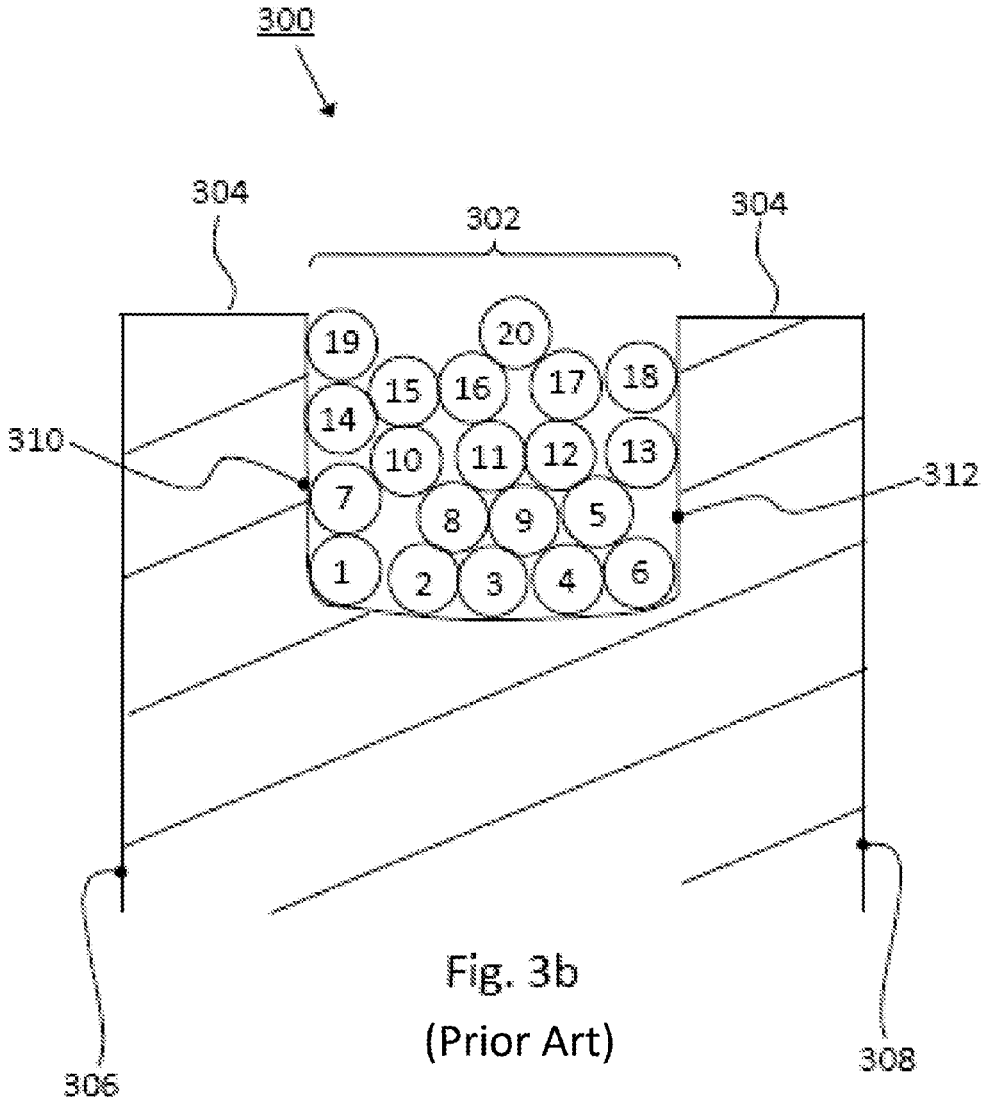
Fig. 3b (Prior Art)
FIG. 3*b* is a simplified cross-sectional view showing enlarged detail of the edge of a prior art line deploying apparatus, and depicts a plurality of turns of a line that is improperly wound within the generally rectangular-shaped channel.

FIGS. 3*a* and 3*b* are simplified cross sectional views showing a portion of a prior art line deploying apparatus, proximate an edge thereof. The prior art line deploying apparatus 300 has a generally rectangular-shaped circumferential channel 302 extending along the edge 304, approximately midway between opposite end surfaces 306 and 308. More particularly, FIG. 3*a* shows a plurality of turns (1 through 20) of a line that are properly wound within the channel 302, and FIG. 3*b* depicts a plurality of turns (1 through 20) of a line that are improperly wound within the channel 302. The width of the channel 302 is constant along a radial inward direction, such that the initial turns of the line must be wound in a side-by-side fashion (e.g., turns 1 through 5). Provided that sufficient care is taken during winding of the line within the channel 302, subsequent turns of the line (e.g., turns 6 through 20) may be wound so that the line deploys properly without tangling. Unfortunately, as is shown in FIG. 3*b*, the shape of the channel 302 of the prior art device also permits the turns of the line to be wound such that later-wound turns interfere with the unwinding of the earlier-wound turns. In the example that is shown in FIG. 3*b*, turn 5 initially is wound directly onto turn 4, and then it is shifted sideways onto turns 4 and 6 as additional turns are wound within the channel 302. During deployment, turn 6 becomes wedged or trapped between turn 5 and the sidewall 312 of the channel 302, thereby causing the unwinding of the line to stop fully six turns, or approximately 10-12 feet, short of its maximum reach. Since the sidewalls 310 and 312 are parallel one relative to the other, the turn 6 must be pulled out of the channel 302 either in a direction that is parallel to the sidewalls 310 and 312 or in a direction that is toward the center of the channel 302. In either case, the sidewall 312 and the turn 5 prevent the turn 6 from unwinding. This is in contrast to the line deploying apparatus 100 according to the embodiment of the instant invention, in which the circumferential channel 112 is V-shaped so as to allow the similarly trapped turn 14 to be pulled out of the channel 112 in a direction that is away from the center of the channel 112, and therefore also away from turn 15.

The embodiment of the instant invention that is described with reference to FIGS. 1*a-d* and FIG. 2 is intended to be a specific and non-limiting example in which the line deploying apparatus is a water-rescue device. Of course, numerous other uses may be envisaged for a line deploying apparatus that trails a rope or cord. Other uses include conveying a connecting rope between vessels or between a vessel and a dock, or conveying tie-down line over a load that is being secured to a vehicle, etc. Depending on the intended use, different disc sizes may be used, different materials may be used to form the disc, the hole in the disc may be omitted, the loop at the free end of the line may be omitted, different lengths of line may be attached to the disc, a different number of turns of the line may be wound onto the disc, etc. For instance, an apparatus that is intended for conveying a tie-down line over a load may use a smaller-sized disc with a shorter length of line attached thereto.

Figure 1E:
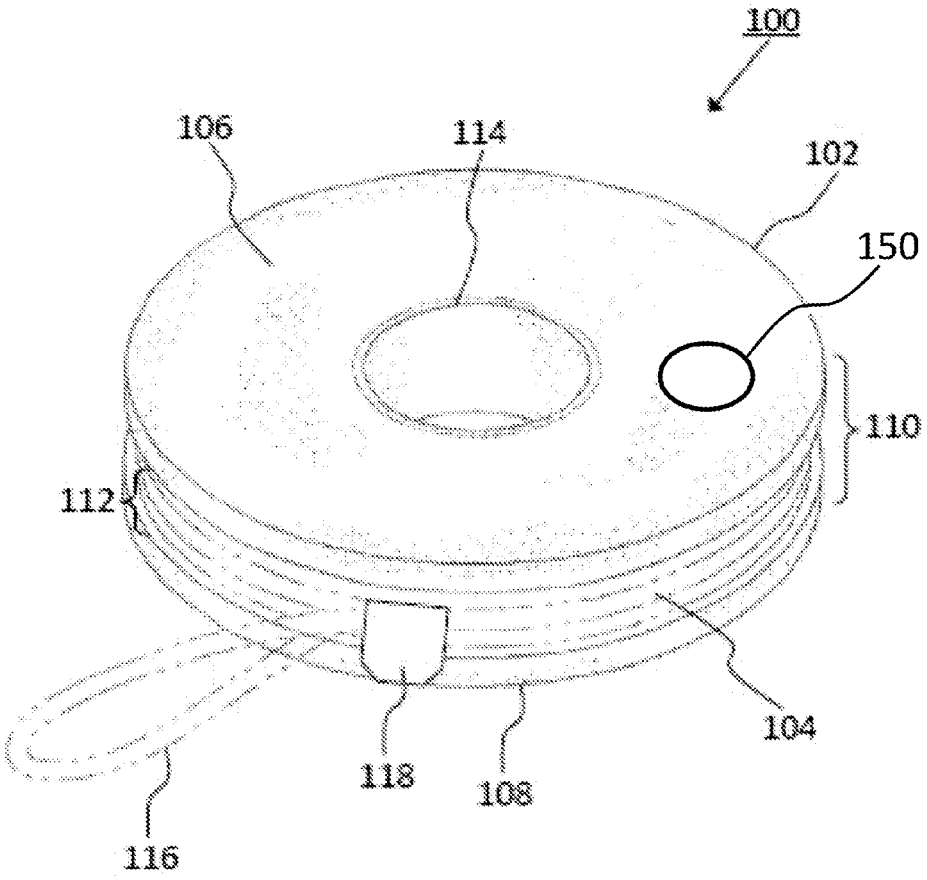
FIG. 1*e* is a front elevation view showing a line deploying apparatus including a light mechanism, according to an embodiment of the instant invention, with a line wound thereon.
Figure 1F:
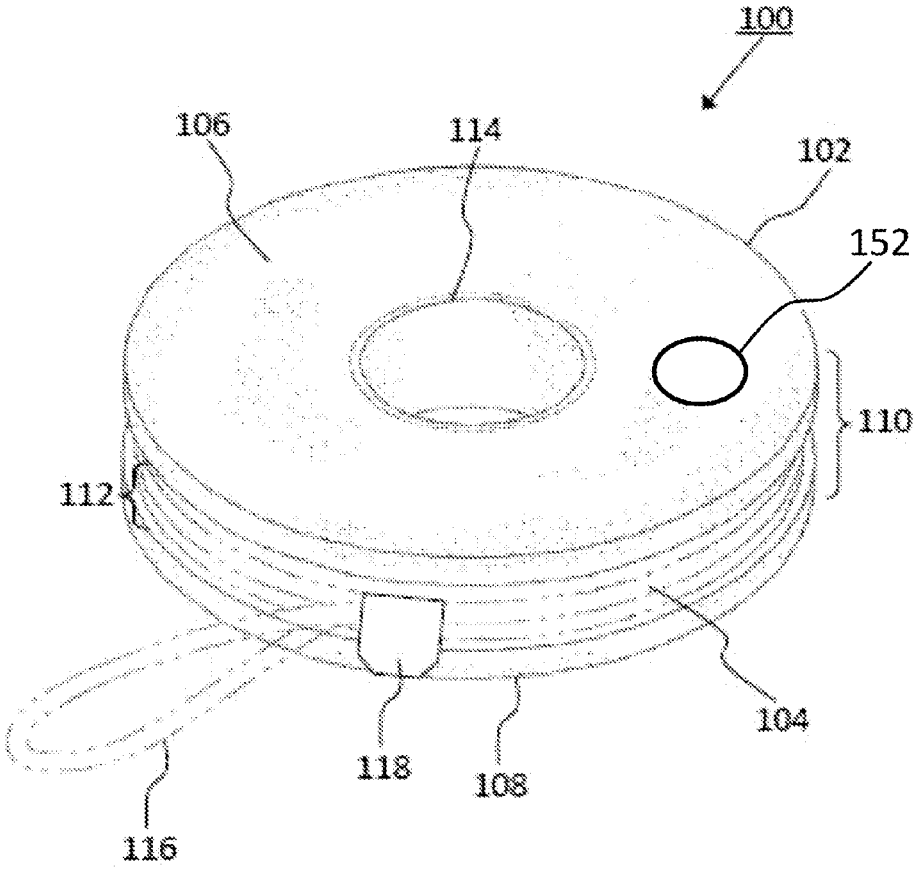
FIG. 1*f* is a front elevation view showing a line deploying apparatus with a sound generator, according to an embodiment of the instant invention, with a line wound thereon.

Of course, a line-deploying apparatus that is intended for use in water rescue situations optionally includes other beneficial features, including visibility enhancing features such as for instance a light mechanism (150 in FIG. 1*e*) or a sound generator (152 in FIG. 1*f*) incorporated into the disc and/or fabricating the disc from brightly colored foam material, etc. In particular, the light mechanism or sound generator help to guide the victim toward the disc under conditions of low lighting (night time) or wavy/foggy surface conditions.

With particular reference to FIGS. 1*a*-1*d* and FIG. 2, a device that is suitable for water rescue applications is provided, which provides many of the desirable features that are noted above. In particular the foam disc 102 provides buoyancy, the V-shaped circumferential channel 112 contributes to improved accuracy and reach during deployment and helps to prevent dive during rescue. Further, the device is of compact size and is easy to use, is constructed of materials that are not likely to cause injury to the person in the water, and may be easily gripped. In addition, the V-shaped circumferential channel 112 improves reliability since the risk of improperly winding the line 104 onto the disc 102 is reduced, which in turn reduces the probability that the line 104 will become tangled during deployment. As will be apparent to one of ordinary skill in the art, even a relatively small probability that the line will become tangled during any particular deployment represents more than just a minor inconvenience. In a life-saving situation, where a person is struggling to stay afloat in the water, the time that would be required to retrieve a tangled device, clear the tangle, and redeploy the device could cost the person his or her life. As such, even an incremental reduction of the probability of a tangle occurring represents a significant improvement.

Numerous other embodiments may be envisaged without departing from the scope of the instant invention.

What is claimed is:

1. An apparatus for deploying a line, comprising:

a disc having a top side, a bottom side, and an edge extending circumferentially around the disc, a generally V-shaped circumferential channel being defined between the top side and the bottom side and being open at the edge of the disc, the circumferential channel having opposing sidewalls that converge continuously one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane, wherein the circumferential channel accommodates a predetermined length of the line when a plurality of turns of the line is wound onto the disc, and wherein the opposing sidewalls of the circumferential channel cooperate to guide a first turn of the line that is wound onto the disc toward the central plane.

2. The apparatus of claim 1 wherein the disc is fabricated from a material that is buoyant in water.

3. The apparatus of claim 1 wherein the disc is fabricated from a foam material.

4. The apparatus of claim 1 wherein a hole is defined through the disc, the hole extending between central openings defined one each in the top and bottom sides of the disc.

5. The apparatus of claim 1 comprising a retaining clip for retaining the line in a wound condition on the disc.

6. The apparatus of claim 1 wherein the circumferential channel is sized to accommodate at least 20 turns of the line being wound onto the disc.

7. The apparatus of claim 1 comprising at least one of a light mechanism and a sound generating mechanism mounted to the disc.

8. An apparatus for deploying a line, comprising:

a throwable disc having a top side, a bottom side, and an edge extending circumferentially around the disc, a generally V-shaped circumferential channel being defined between the top side and the bottom side of the disc and being open at the edge of the disc, the circumferential channel having opposing sidewalls that converge continuously one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane; and a line having one end attached to the disc and having a free end opposite the attached end, the free end for being grasped by a user throwing the throwable disc, wherein the circumferential channel houses a predetermined length of the line when a plurality of turns of the line is in a wound condition, and wherein the opposing sidewalls of the circumferential channel cooperate to guide a first turn of the line that is wound onto the disc toward the central plane.

9. The apparatus of claim 8 wherein the disc is fabricated from a material that is buoyant in water.

10. The apparatus of claim 8 wherein the disc is fabricated from a foam material.

11. The apparatus of claim 8 wherein a hole is defined through the disc, the hole extending between central openings formed one each in the top and bottom sides of the disc.

12. The apparatus of claim 8 comprising a retaining clip for retaining the line in a wound condition on the disc.

13. The apparatus of claim 8 wherein the circumferential channel is sized to accommodate at least 20 turns of the line being wound onto the disc.

14. The apparatus of claim 8 comprising at least one of a light mechanism and a sound generating mechanism mounted to the disc.

15. The apparatus of claim 8 wherein the line is formed into a first loop proximate the free end thereof.

16. The apparatus of claim 8 wherein the line is formed into a second loop proximate the attached end thereof.

17. The apparatus of claim 8 wherein the line is at least 50 feet long and is buoyant in water.

18. The apparatus of claim 8 wherein a width of the circumferential channel between the opposing sidewalls, as measured in a direction that is normal to both the top and bottom sides of the disc, decreases continuously from the edge of the disc to the point of intersection of the opposing sidewalls.

19. An apparatus for deploying a line, comprising:

a throwable disc fabricated from a material that is buoyant in water, the disc having a top side, a bottom side, and an edge extending circumferentially around the disc, a generally V-shaped circumferential channel being defined between the top side and the bottom side of the disc and being open at the edge of the disc, the circumferential channel having opposing sidewalls that converge continuously one toward the other along a radial inward direction, from the edge of the disc toward the center of the disc, the circumferential channel being substantially symmetric about a central plane that is defined midway between the top side and the bottom side of the disc, and the sidewalls of the circumferential channel intersecting at said plane; and a line that is buoyant in water and having one end attached to the disc and having a free end opposite the attached end, the free end for being grasped by a user throwing the throwable disc, wherein the circumferential channel houses a predetermined length of the line when a plurality of turns of the line is in a wound condition, and wherein the opposing sidewalls of the circumferential channel cooperate to guide a first turn of the line that is wound onto the disc toward the central plane.

* * * * *